US005611125A

United States Patent [19]

Williams et al.

[11] Patent Number: 5,611,125

[45] Date of Patent: Mar. 18, 1997

[54] CONCRETE FILLED CONTAINER BURIAL VAULT

[76] Inventors: Robert Williams, 649 Kathleen Dr., Schereville, Ind. 46375; Robert B. Williams, 11221 W. 80th Ct., St. John, Ind. 46373; Gary J. Williams, 5100 Industrial Hwy., Gary, Ind. 46406

[21] Appl. No.: 522,197

[22] Filed: Aug. 31, 1995

[51] Int. Cl.[6] ..... A61G 17/00

[52] U.S. Cl. ..... 27/3; 27/14

[58] Field of Search ..... 27/2, 3, 14, 35, 27/16, 27, 32, 33; 52/128, 133, 134, 135, 439, 427, 428, 426

[56] References Cited

U.S. PATENT DOCUMENTS

| | | | |
|---|---|---|---|
| 565,282 | 8/1896 | Kolie | 27/16 |
| 1,055,825 | 3/1913 | Snyder | 27/35 |
| 1,928,671 | 10/1933 | Mitchell | 27/35 |
| 3,208,188 | 9/1965 | Fulton et al. | 27/35 |
| 3,439,461 | 4/1969 | Chandler | 52/139 |
| 3,839,768 | 10/1974 | McQuestion | 27/35 |
| 4,060,581 | 11/1977 | Darby | 264/131 |
| 4,128,981 | 12/1978 | Juba | 52/309.3 |
| 5,245,733 | 9/1993 | Goria | 27/35 |
| 5,311,718 | 5/1994 | Trousilek | 52/439 X |

*Primary Examiner*—Kien T. Nguyen
*Attorney, Agent, or Firm*—Don Moyer

[57] ABSTRACT

A container with a lid sealed thereon wholly encloses a space which can contain a casket. The container wall, the lid wall, and the seal bar flow of matter into the space containing the casket. The container wall and the lid wall both also wholly enclose chambers which am filled with concrete. There is a fenestrated spacer attached between the walls of both the concrete filled container chamber and the concrete filled lid chamber with the concrete passing through the fenestrated spacer to link the concrete filling the container chamber to the container and to link the concrete filling the lid chamber to the lid to give the container and the lid the strength of concrete.

10 Claims, 1 Drawing Sheet

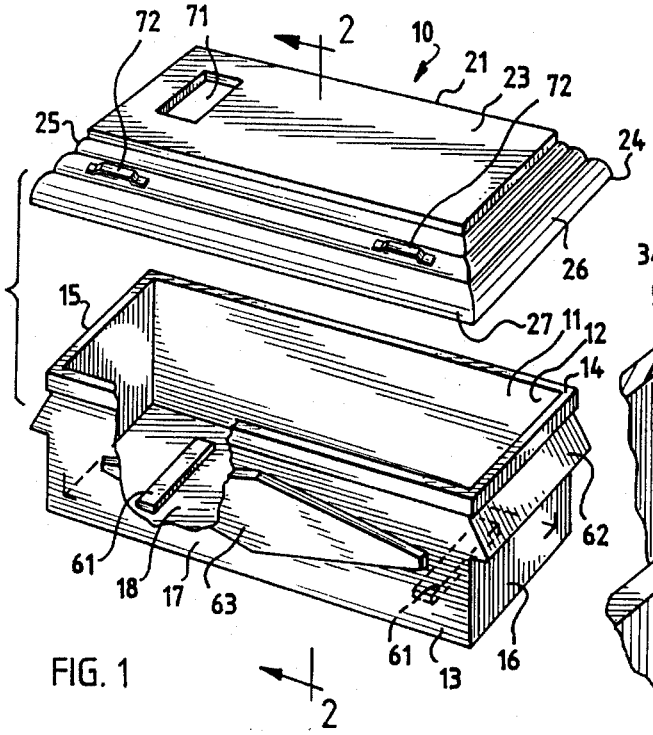
FIG. 1
FIG. 3
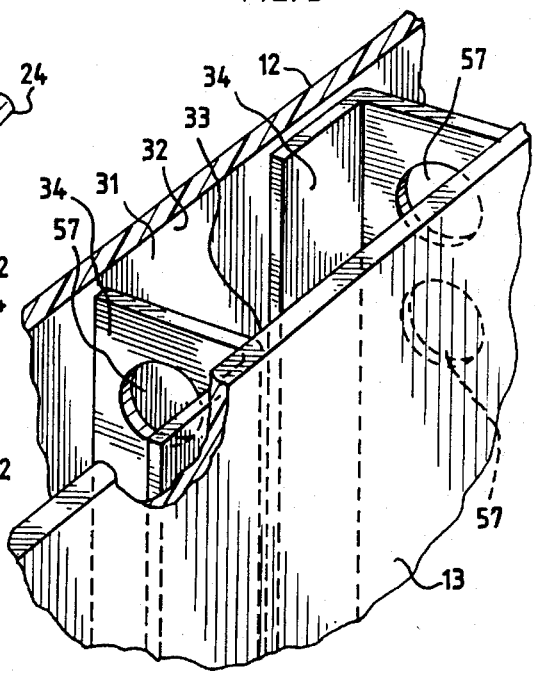
FIG. 2
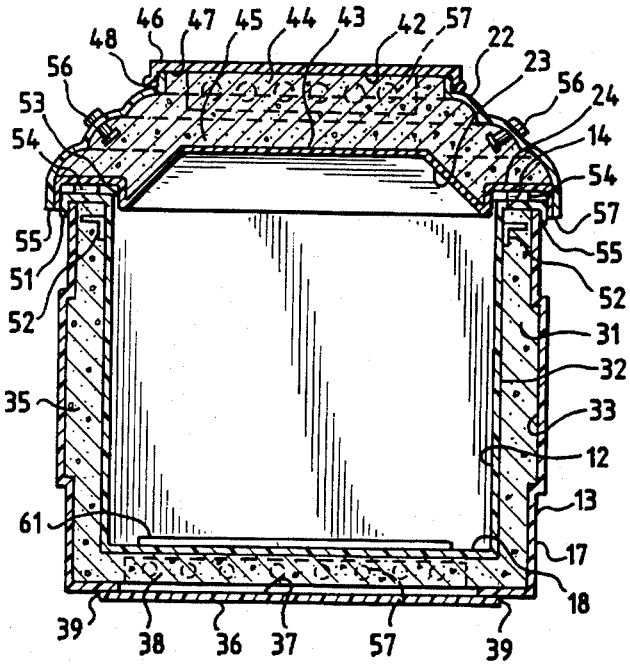
FIG. 4
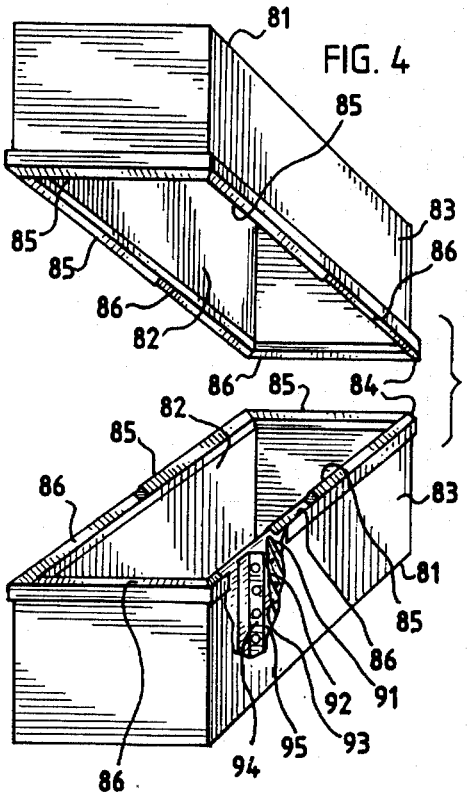

CONCRETE FILLED CONTAINER BURIAL VAULT

BACKGROUND OF THE INVENTION

Burial vaults are made of concrete so that the vaults can withstand the weight of the earth cover, can withstand the added weight of earth-handling machinery, and can withstand water pressure and other forces from the surrounding earth. The main advantages of concrete are high strength at low cost, and ease of construction by casting means, well known in the art, which involve only a few manufacturing steps. Concrete however does not provide a sufficient barrier to keep water and other matter from penetrating into the vault, and concrete does not have a satisfactorily pleasing appearance.

In order to provide a better barrier to flow of matter into the burial vault, several schemes for cladding concrete burial vaults with plastic have been proposed. The key features in these proposals are the adhering means at the plastic to concrete interface. Chandler's U.S. Pat. No. 3,439,461 proposes applying a wet and tacky adhesive onto the surfaces of a plastic mold before filling the mold with concrete so that the adhesive and the concrete will cure together and be bonded at the interface. McQuestion's U.S. Pat. No. 3,839,768 seeks to overcome the added manufacturing steps which are required to use adhesive as the adhering means at the plastic to concrete interface. To do this McQuestion proposes to attach fiberglass loops to the surfaces of a plastic mold so that, when the mold is filled with concrete, the loops will be embedded in the concrete. In U.S. Pat. No. 4,060,581 Darby seeks to overcome the problem where at least some of the wet and tacky adhesive pre-applied to surfaces of a plastic mold is scrubbed away when the concrete is poured into the mold. Darby proposes to adhere aggregate to surfaces of the plastic mold so that when the mold is filled with concrete and the concrete cured the pre-applied aggregate provides the adhering means at the plastic to concrete interface. Juba's U.S. Pat. No. 4,128,981 proposes using a dry adhesive to minimize the scrubbing problem.

All of these proposals require preparation of special adhering means at the interface between surfaces of the plastic mold and the concrete fill and thereby these proposals need a number of manufacturing steps which take special care to insure that the interface bond will have the strength needed for burial vaults. Thus, there is an opportunity to devise a concrete filled container burial vault in which the links tying the concrete to a container are provided by the structure of the container itself, which needs less manufacturing steps, and for which the manufacturing steps are all well known in the art and do not require special care.

SUMMARY OF THE INVENTION

Objects of this invention include the following. Make a burial vault in which a container provides a barrier to flow of matter through the container wall. Make a burial vault in which the form of a container gives the vault high commercial appeal. Make a burial vault in which concrete provides the strength required for the burial vault. Make a burial vault in which means for linking the concrete and the container am provided by parts of the container itself. Make a burial vault which requires few manufacturing steps. Make a burial vault for which the manufacturing steps are all well known in the an. Make a burial vault for which the manufacturing steps do not require special care.

In Summary, one embodiment of this invention is a container which has a containing wall portion and an exposed wall portion which are joined at a brim to comprise a container wall which bars flow of matter through the exposed wall portion and through the containing wall portion. The container has a chamber with an inner wall portion continuous with the containing wall portion and an outer wall portion continuous with the exposed wall portion. A fenestrated spacer is attached between the chamber inner wall and the chamber outer wall and the chamber is filled with concrete which passes through the fenestrated spacer to link the concrete to the container and give the container the strength of concrete. A seal which can bar flow of matter through the seal can seal two generally identical replicas of the container together along their brims to form a wholly enclosed space which can contain a casket.

Other equivalent embodiments will be comprehended in the detailed description of the drawings, which will make additional equivalent embodiments obvious to people skilled in the art.

DRAWING FIGURES

FIG. 1 shows a container and a lid forming a burial vault.

FIG. 2 is a cross section taken on line 2—2 in FIG. I showing the container wall, the lid wall, and the concrete filled chambers of the container and the lid.

FIG. 3 shows two ways to attach a fenestrated spacer to the chamber wall.

FIG. 4 shows two generally identical containers forming a burial vault.

DETAILED DESCRIPTION OF THE DRAWINGS

The new burial vault 10, shown in FIG. 1, is a container 11 which can be covered by a lid 21 to form a wholly enclosed space which can contain a casket. The container 11 has a containing wall portion 12, an exposed wall portion 13, and a brim 14 where the containing wall portion joins the exposed wall portion. These elements 12, 13, 14 together comprise a container wall which bars flow of matter through the container exposed wall portion and through the container containing wall portion.

The container containing wall portion has a floor 18 which has protrusions 61 upon which a casket can rest leaving a space between the casket and the floor 18. The container exposed wall portion has a head 15 and a foot 16 each of which have a wedge shaped protrusion 62. The protrusions 62 can hold straps which can be used to lift the container. The container exposed wall portion also has long sides 17 each of which has a diamond shaped protrusion 63 to provide a pleasing appearance.

The lid 21 has a lid containing wall portion 22, a lid exposed wall portion 23, and a lid brim 24 where the lid containing wall portion joins the lid exposed wall portion. Together these elements 22, 23, 24 comprise a lid wall which bars flow of matter through the lid exposed wall portion and through the lid containing wall portion. The lid has a head 25 and a foot 26 with an inset 71 for holding a nameplate near the head 25. The lid has long sides 27 with four handles 72, two each at the head and foot ends of the long sides.

FIG. 2 shows details of construction of the container 11 and lid 21. The container has a chamber 31 which has a chamber inner wall portion 32 continuous with the container containing wall portion 12 and which has a chamber outer wall portion 33 continuous with the container exposed wall portion 13. The elements 32 and 33 comprise the chamber wall.

A fenestrated spacer 34 seen in FIG. 3 is attached to the chamber wall and extends between the chamber inner wall portion 32 and the chamber outer wall portion 33. The fenestrated spacer has a fight angle form with a fenestrated arm extending across the chamber and with a non-fenestrated arm which can be attached to the chamber inner wall portion and alternatively can be attached to the chamber outer wall portion. In the preferred embodiment the fenestrated spacer has twenty sections extending vertically from near the floor to near the brim of the container. Along each long side six fenestrated spacer sections are attached alternately to the chamber inner wall portion and to the chamber outer wall portion. The head and foot ends each have four fenestrated spacer sections attached alternately to the chamber inner wall portion and to the chamber outer wall portion.

Concrete 35 fills the chamber and passes through the fenestrated spacer. This links the concrete to the container and gives the container the strength of the concrete. A portion of the container exposed wall portion is a cover 36 which seals an opening 37 into the chamber 31. The cover is larger than the opening and forms a double thick portion of the container exposed wall portion where the cover is bonded 39. The concrete filling the chamber 35 was poured into the chamber before the opening was sealed by the cover 36. A cover fenestrated spacer 38 is attached to the cover 36 so that the concrete 35 passes through this fenestrated spacer section to link the concrete to the cover.

The lid 21 has a lid chamber 41 which has a lid chamber inner wall portion 42 continuous with the with the lid containing wall portion 22 and which has an lid chamber outer wall portion 43 continuous with the lid exposed wall portion 23. The elements 42 and 43 comprise the lid chamber wall. A portion of the lid exposed wall portion is a lid cover 46 which seals an opening 47 into the lid chamber. The lid cover forms a double thick portion of the lid exposed wall portion where it is bonded 48. The concrete filling the lid chamber 45 was poured into the lid chamber before the opening 47 was sealed by the lid cover 46. A lid cover fenestrated spacer 44 is attached to the lid cover 46 so that the concrete 45 passes through this fenestrated spacer section to link the concrete to the lid cover.

The container is made in two large pain which am bonded to make a double-thick portion 51 of the exposed wall portion at the brim 14. A brim fenestrated spacer 52 is attached to the chamber inner wall portion 32 just below the brim. This fenestrated spacer section extends around the periphery of the chamber inner wall just below the brim with the fenestrated arm extending to the chamber outer wall so that when the attachment 51 is made, force can be applied across the brim 14 from the container containing wall portion 12 to the container exposed wall portion 13 while the bond cures. The vertical fenestrated spacer sections 34 also help keep the two parts of the container wall positioned as they am being joined at the double thick portion 51 of the brim 14. The lid is made of two large pieces which are bonded to make a double-thick portion 55 of the lid exposed wall portion at the lid brim 24. The lid brim forms a seat 53 which is just larger than the container brim 14 so that the container brim can be enclosed within the seat 53. Sealant is placed on the container brim before the lid is seated on the container so that the sealant bars flow of matter into the closed vault by any path between the container and the lid.

Eight anchors 56 for attaching the four handles 72 am passed through holes in the lid exposed wall portion into the concrete filled lid chamber before the concrete has set so that the anchors will be linked to the concrete. The holes in the lid required for these anchors are sealed when the handles are attached.

FIG. 4 shows how the new burial vault can be formed from one kind of basic container 81 which has a containing wall portion 82 and an exposed wall portion 83 which am joined at a brim 84 to comprise a container wall which bars flow of matter through the exposed wall portion and through the containing wall portion. This basic container has a chamber 91 with an inner wall portion 92 continuous with the containing wall portion 82 and an outer wall portion 93 continuous with the exposed wall portion 83. A fenestrated spacer 94 is attached between the chamber inner wall 92 and the chamber outer wall 93 and the chamber is filled with concrete 95 which passes through the fenestrated spacer to link the concrete to the container and give the container the strength of concrete. Two generally identical replicas of this basic container can be sealed together along their brims 84 to form a wholly enclosed space which can contain a casket. The brim of this basic container can be made symmetrically in the form of a tongue 85 half way around the brim periphery and in the form of a grove 86 halfway around the periphery of the brim, so that the two replicas can be tongue-to-grove sealed together along their brims 84.

In the preferred embodiment the container wall, the lid wall, and the fenestrated spacer are ABS plastic. The fenestrated spacer is attached to the container wall and lid wall using a solvent adhesive made of methyl ethyl keytone mixed with ABS plastic chips which forms a very strong bond. The container brim bond 51 is also made using this adhesive. The openings in the fenestrated spacer are circular holes 57 drilled through the plastic. Low moisture content concrete is used to fill the container chamber and the lid chamber, and, after full curing, the container wall and lid wall are observed to be tight against the concrete fill. The container cover 36 and the lid cover 46 are sealed using a commercial silicone adhesive. The seal 54 of the container balm 14 to lid brim seat 53 is made using a commercial butyl lubber joint sealant.

Other arrangements, such as a fenestrated spacer curving up and down the chamber wall, or attaching the fenestrated spacer to both the inner and outer chamber wall portions, or other shapes for the fenestrated spacer, or various shaped openings in the fenestrated spacer would be equivalent. Similarly other means for attaching and sealing or use of other materials for the container wall would be equivalent.

Other equivalent forms for the new burial vault and other equivalent forms for the fenestrated spacer will be obvious to people skilled in the art. It is understood therefore that this invention is not limited to the particular examples illustrated here.

We claim:

1. A vault comprising:

a container with a container wall, the container wall having a containing wall portion, an exposed wall portion, and a brim where the containing wall portion joins the exposed wall portion, the container wall baring flow of matter through the exposed wall portion and through the containing wall portion;

a chamber wholly enclosed by a chamber wall, the chamber wall having an inner wall portion continuous with the container containing wall portion, and the chamber wall having an outer wall portion continuous with the container exposed wall portion;

an inner fenestrated spacer attached to the chamber inner wall portion wall and extending toward the chamber outer wall portion and an outer fenestrated spacer attached to the chamber outer wall portion and extending toward the chamber inner wall portion; and concrete filling the chamber and passing through the fenestrated spacer so that the concrete is linked to the container wall and so that the container has the strength of the concrete; wherein a portion of the container exposed wall portion is a cover sealing an opening to the chamber through which the concrete was poured, a cover fenestrated spacer being attached to the cover and extending into the chamber to link the cover to the concrete.

2. The vault of claim 1 further comprising a seal which can bar flow of matter through the seal while sealing two generally identical replicas of the container together along their brims to form a wholly enclosed space which can contain a casket.

3. The vault of claim 1 further comprising:

a lid with a lid wall, the lid wall having a lid containing wall portion, a lid exposed wall portion, and a lid brim where the lid containing wall portion joins the lid exposed wall portion, the lid wall baring flow of matter through the lid exposed wall portion and through the lid containing wall portion;

a lid chamber wholly enclosed by a lid chamber wall, the lid chamber wall having a lid chamber inner wall portion continuous with the lid containing wall portion and having a lid outer wall portion continuous with the lid exposed wall portion;

a lid fenestrated spacer attached to the lid chamber outer wall portion and extending toward the lid inner wall portion;

concrete filling the lid chamber and passing through the lid fenestrated spacer so that the concrete is linked to the lid wall and so that the lid has the strength of concrete; and a seal which can bar flow of matter through the seal while sealing the lid brim to the container brim to form a wholly enclosed space which can contain a casket.

4. The vault of claim 3 wherein a portion of the lid exposed wall portion is a lid cover sealing a lid opening to the lid chamber through which the concrete was poured, a lid cover fenestrated spacer being attached to the lid cover and extending into the lid chamber to link the lid cover to the concrete.

5. The vault of claim 4 further comprising an inset in the lid cover for holding a name plate.

6. The vault of claim 3 further comprising handles attached to the lid.

7. The vault of claim 1 wherein the container exposed wall portion has a head end and a foot end, the head end and the foot end both having a protrusion, the protrusion for holding straps which can be used to lift the container.

8. The vault of claim 1 wherein the container containing wall portion has a floor, the floor having a protrusion upon which a casket can rest leaving a space between the casket and the floor.

9. The vault of claim 1 further comprising diamond shaped protrusions in long sides of the container exposed wall portion.

10. The vault of claim 1 further comprising a brim fenestrated spacer attached to the chamber inner wall portion and extending toward the chamber outer wall portion around the periphery of the chamber just below the brim.

* * * * *